US005523548A

United States Patent [19]

Tsukagoshi et al.

[11] Patent Number: 5,523,548

[45] Date of Patent: Jun. 4, 1996

[54] ELECTROMAGNETIC WAVE HEATER HAVING A CONE-SHAPED CONTAINER WHOSE TAPERED PORTION IS POINTED AND DIRECTED TOWARD THE ELECTROMAGNETIC WAVE GENERATOR

[75] Inventors: Tsuneo Tsukagoshi; Kenichi Hatakeyama, both of Tokyo, Japan

[73] Assignee: NEC Corporation, Tokyo, Japan

[21] Appl. No.: 381,444

[22] Filed: Jan. 31, 1995

[30] Foreign Application Priority Data

| | | | |
|---|---|---|---|
| Jan. 31, 1994 | [JP] | Japan | 6-009029 |
| May 17, 1994 | [JP] | Japan | 6-101465 |
| Jun. 6, 1994 | [JP] | Japan | 6-123413 |
| Jun. 6, 1994 | [JP] | Japan | 6-123414 |
| Jul. 5, 1994 | [JP] | Japan | 6-153191 |

[51] Int. Cl.[6] ..... H05B 6/72; H05B 6/76

[52] U.S. Cl. ..... 219/695; 219/690; 219/762; 219/736

[58] Field of Search ..... 219/695, 690, 219/691, 693, 694, 762, 696, 697, 750, 757, 736, 737, 738, 744

[56] References Cited

U.S. PATENT DOCUMENTS

| | | | |
|---|---|---|---|
| 2,820,127 | 1/1958 | Argento et al. | 219/750 |
| 3,440,383 | 4/1969 | Smith | 219/725 |
| 3,564,458 | 2/1971 | Cumming | 219/695 |
| 3,666,904 | 5/1972 | Krajewski | 219/744 |
| 3,909,574 | 9/1975 | Muller et al. | 219/744 |
| 4,752,663 | 6/1988 | Meisel | 219/746 |
| 4,874,915 | 10/1989 | Harms et al. | 219/759 |

FOREIGN PATENT DOCUMENTS

| | | | |
|---|---|---|---|
| 56-54548 | 12/1981 | Japan . | |
| 63-299084 | 12/1988 | Japan | 219/690 |
| 2-223186 | 9/1990 | Japan | 219/693 |

*Primary Examiner*—Philip H. Leung
*Attorney, Agent, or Firm*—Young & Thompson

[57] ABSTRACT

An electromagnetic wave heater comprises an electromagnetic wave generator a wave guide being connected to the generator for guiding the generated electromagnetic wave to be propagated in a uniform direction, at least one container being provided in the wave guide for accommodating an object to be heated up by irradiation of the electromagnetic wave, the container having at least one tapered portion, a pointed end of which faces to a direction of the propagation of the electromagnetic wave in the wave guide.

7 Claims, 8 Drawing Sheets

ELECTROMAGNETIC WAVE HEATER HAVING A CONE-SHAPED CONTAINER WHOSE TAPERED PORTION IS POINTED AND DIRECTED TOWARD THE ELECTROMAGNETIC WAVE GENERATOR

BACKGROUND OF THE INVENTION

Field of the Invention

The invention relates to an electromagnetic wave heater for heating objects, and more particularly to an electromagnetic wave heater for burning up or drying industrial wastes such as uncooked foods and plastics.

Description of the Related Art

Microwave heaters have been widely used in various industries and household microwave ovens. Electromagnetic wave or microwave heaters heats an object up by subjecting a large dielectric loss material such as water to an electromagnetic wave or a microwave to cause a heat generation proportional to an amount of the dielectric loss. A typical one of the microwave heaters is illustrated in FIG. 1 in which the heater comprises an electromagnetic wave generator 1, a waveguide 2 and an applicator 7. The applicator 7 accommodates a turn table 8 on which an object 4 to be heated is placed. The wave-guide 2 connects between the electromagnetic wave generator 1 and the applicator 7 to guide the electromagnetic wave or microwave generated by the generator 1 into the applicator to thereby permitting the electromagnetic wave or microwave to be applied on the object 4 placed on the turn table during which the turn table is kept in turning or rotation.

The wave-guide 2 is connected on a top or side face of the applicator 7 to permit the microwave to irradiate on the object. The applicator 7 has a metal inside wall by which the microwave tends to be reflected irregularly so that the reflected microwave irradiates symmetrically on the object in various directions. As a result, the microwave is not sufficiently absorbed by the object but reflected thereby. The reflective ratio of the microwave by the object depends upon the shape and size of the object. Actually, approximately a half of the microwave output power may contribute to heat up the object.

To improve the efficiency of the heating up of the object, it was proposed that the applicator 7 was designed to form a resonator as illustrated in FIG. 2. Such technical idea is disclosed in the Japanese Patent Publication No. 56-54548. In this case, the dielectric constant is variable by changes of temperature of the object to be heated up and a cap thereof. For that reason, an impedance adjuster 9 is provided between an electric wave generator 1 and the applicator 7 so that a microwave generated by the generator 1 is adjusted by the adjuster 9 to follow the change of the dielectric constant of the object to keep the optimization of the resonant state in the applicator 7.

The above resonant type of the applicator requires that a power monitor is provided in the wave guide for guiding the microwave to monitor both an incident wave and a reflected wave so that a tuning of a adjuster rod is made to keep a smallest amount of the reflected wave. To achieve the above, it is required to provide a power monitor, an adjusting and moving device and a control system for controlling the same. Introduction of such system may result in an expensive heating system, for which reason it is preferable that the microwave heater has no complicated system to result in a large cost thereof.

SUMMARY OF THE INVENTION

Accordingly, it is a primary object of the present invention to provide a novel microwave heater capable of heating up an object at a high heating up efficiency and free from any problems as described above.

It is a further object of the present invention to provide a novel microwave heater with a simple structure and a low cost.

It is a furthermore object of the present invention to provide a novel microwave heater capable of heating up an object in a wide range of dielectric constant.

It is a moreover object of the present invention to provide a novel microwave heater capable of heating up an object uniformly.

It is another object of the present invention to provide a novel microwave heater capable of heating up an object without without any scattering thereof.

The above and other objects, features and advantages of the present invention will be apparent from the following descriptions.

The invention provides a novel microwave heater which may comprise a microwave generator for generating a microwave, a wave guide for guiding the generated microwave to be propagated in a direction along the wave guide and a container for accommodating an object to be heated up by the microwave irradiation wherein the container has a bottom with a tapered shape that faces to the direction of the microwave propagation in the wave guide so that the object to be heated up by the microwave is accommodated to form the same shape as the container to thereby improve the absorptivity by the object of the microwave propagated in the uniform direction facing the tapered bottom of the container. It is very important that the container for accommodating the object to be heated up is positioned in the wave guide in which the generated microwave is propagated in the uniform direction along the wave guide so that the object accommodated in the container provided with the tapered bottom facing to the direction of the microwave propagation would be subjected to the microwave irradiation and then exhibits a high efficiency in absorption of the microwave thereby the object is heated up at a high efficiency. The container may be designed to have the tapered bottom of a conical shape, a pyramid or a wedged shape.

BRIEF DESCRIPTIONS OF THE DRAWINGS

Preferred embodiments of the present invention will hereinafter fully be described in detail with reference to the accompanying drawings.

DESCRIPTIONS OF THE INVENTION

According to the present invention, a novel microwave heater may comprise a microwave generator for generating a microwave, a wave guide for guiding the generated microwave to be propagated in a direction along the wave guide and a container for accommodating an object to be heated up by the microwave irradiation wherein the container has a bottom with a tapered shape that faces to the direction of the microwave propagation in the wave guide so that the object to be heated up by the microwave is accommodated to form the same shape as the container to thereby improve the absorptivity by the object of the microwave propagated in the uniform direction facing the tapered bottom of the container. It is very important that the container for accommodating the object to be heated up is positioned in the wave guide in which the generated microwave is propagated in the uniform direction along the wave guide so that the object accommodated in the container provided with the tapered bottom facing to the direction of the microwave propagation would be subjected to the microwave irradiation and then exhibits a high efficiency in absorption of the microwave thereby the object is heated up at a high efficiency. The container may be designed to have the tapered bottom of a conical shape, a pyramid or a wedged shape.

Figure 1:
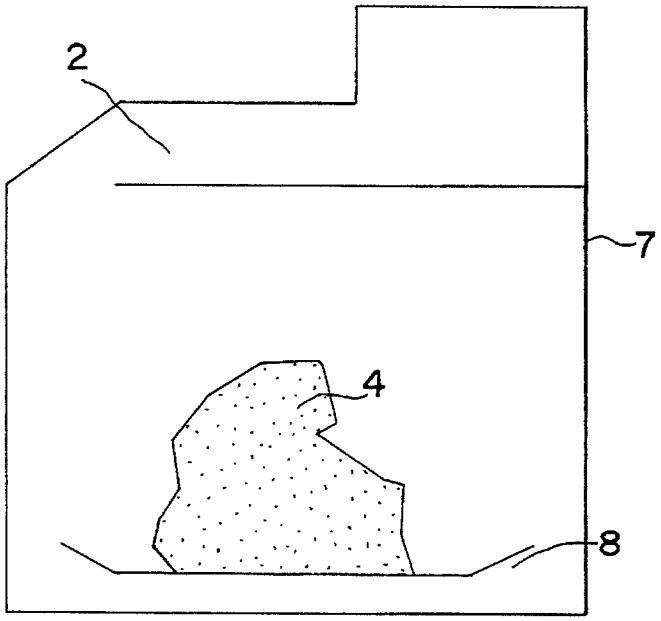
FIG. 1 PRIOR ART
FIG. 1 is a diagram illustrative of the conventional microwave heater.
Figure 2:
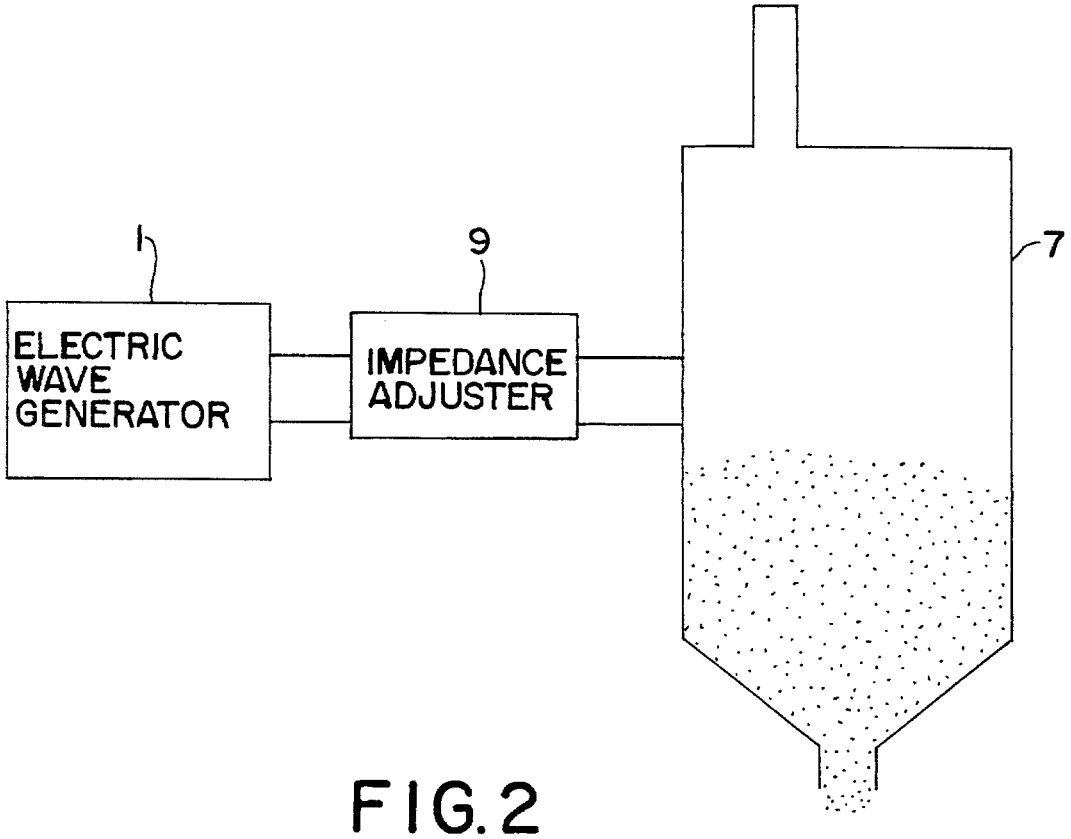
FIG. 2 PRIOR ART
FIG. 2 is a diagram illustrative of the another conventional microwave heater.
Figure 3:
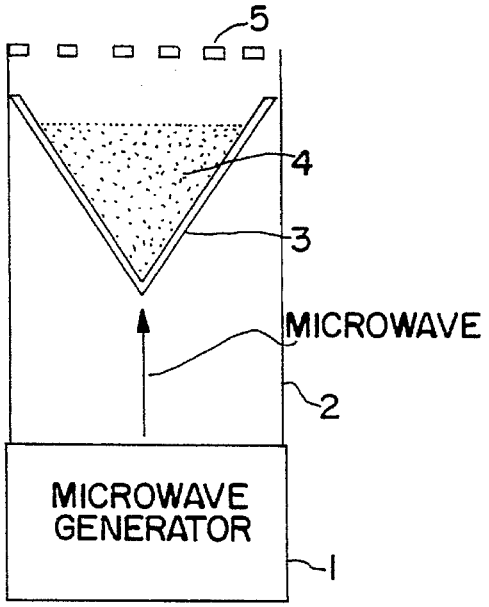
FIG. 3 is a cross sectional elevation view illustrative of a novel microwave heater in a first embodiment according to the present invention.

A first embodiment according to the present invention will be described in which a novel microwave generator as illustrated in FIG. 3 is provided. The microwave heater comprises a microwave generator 1, a wave guide 2 for guiding the generated microwave to be propagated in the uniform direction along the wave guide, a conelike container 3 for accommodating an object 4 to be heated up by the microwave irradiation and being provided with a tapered bottom that faces the propagation direction Of the microwave in the wave guide to thereby permit the object 4 in the form of the tapered shape to exhibit an absorption of the microwave at a high efficiency. The wave guide 2 has one end connected with the microwave generator 1 and the opposite end at which a cap is provided to allow a gap to pass through but cut off the propagation of the microwave. The opposite end of the wave guide has a cap of a microwave shielding structure. The opposite end of the wave guide 2 may comprise a punched metal shield 5 with holes of small diameters. The container 3 may be made of materials having a low dielectric loss such as resin or glass materials. Needless to say, the object to be heated up has to have a high dielectric loss. The wave guide may have a uniform section area. The container may be made of materials with a low dielectric constant such as ceramic.

It is also important that the container with the tapered bottom is provided in the wave guide 2 in which the microwave is propagated in the uniform direction, however never provided in the box type applicator wherein the microwave is propagated in various directions. It is further important that the container 3 with the tapered bottom faces to the propagating direction of the microwave in the wave guide 2 wherein the object to be heated up is also accommodated in the same form as the tapered bottom of the container 3. The above two conditions for the position and the shape of the container are essential to permit the object to show a high absorptivity of the microwave and then to be heated up at a high efficiency. As modifications in the shape of the container 3, a conical shape, a pyramid and a wedged shape are available.

Figure 4:
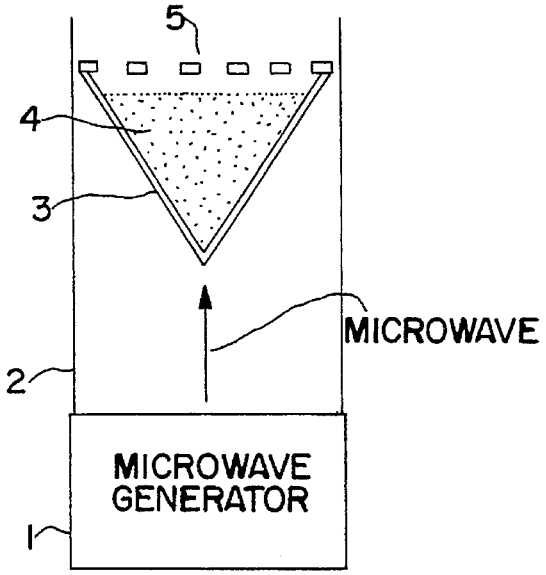
FIG. 4 is a cross sectional elevation view illustrative of a novel microwave heater in a second embodiment according to the present invention.

A second embodiment according to the present invention will be described in which a novel microwave generator are illustrated in FIG. 4 is provided. The microwave heater has the same structure as those of the foregoing embodiment except for the mounting position of the microwave shielding structure. In this embodiment, the punched metal shield 5 as the microwave shielding structure is provided with the top of the container 3. This structure of the microwave heater may also provide almost the same effects and advantages as those of the foregoing embodiments.

Figure 5:
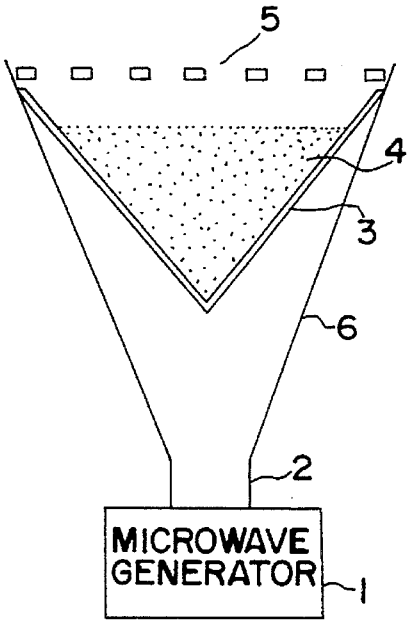
FIG. 5 is a cross sectional elevation view illustrative of a novel microwave heater in a third embodiment according to the present invention.

A third embodiment according to the present invention will be described in which a novel microwave generator as illustrated in FIG. 5 is provided. The microwave heater has the same structure as those of the foregoing embodiment except for a large size of the container 3 and a tapered shape of the wave guide 6. In the tapered shape wave guide, the top portion of the wave guide is expanded but the bottom portion of the wave guide is tapered. Such tapered shape of the wave guide may permit a much larger container 3 to be provided for accommodating a much larger object to be heated up by the microwave by the same phenomenon as described in the first embodiment according to the present invention. This structure of the microwave heater may also provide almost the same effects and advantages as those of the foregoing embodiments.

Figure 6:
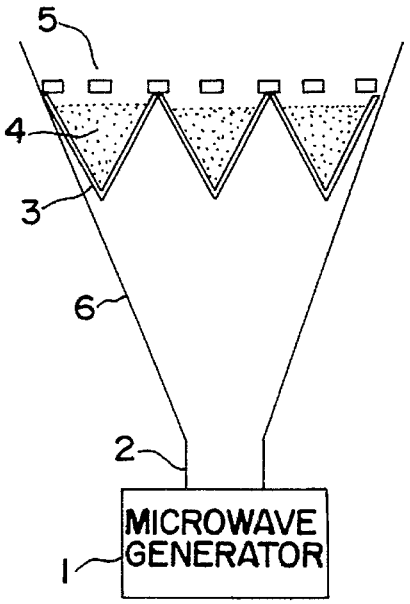
FIG. 6 is a cross sectional elevation view illustrative of a novel microwave heater in a fourth embodiment according to the present invention.

A fourth embodiment according to the present invention will be described in which a novel microwave generator as illustrated in FIG. 6 is provided. The microwave heater has the same structure as those of the foregoing embodiment except for a plurality of the containers 3 and a tapered shape of the wave guide 6. In the tapered shape wave guide, the top portion of the wave guide is expanded but the bottom portion of the wave guide is tapered. Such tapered Shape of the wave guide may permit a plurality of the containers 3 to be provided for accommodating a a plurality of objects to be heated up by the microwave by the same phenomenon as described in the first embodiment according to the present invention. This Structure of the microwave heater may also provide almost the same effects and advantages as those of the foregoing embodiments.

Figure 7A:
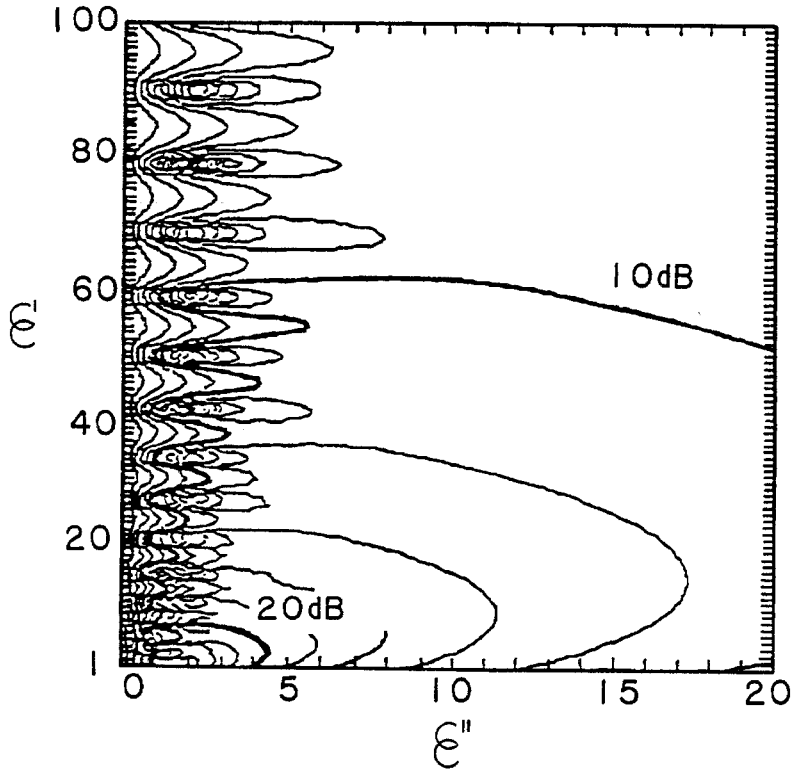
FIGS. 7A and 7B are diagrams illustrative of relationships of dielectric constant and microwave absorptivity.
Figure 7B:
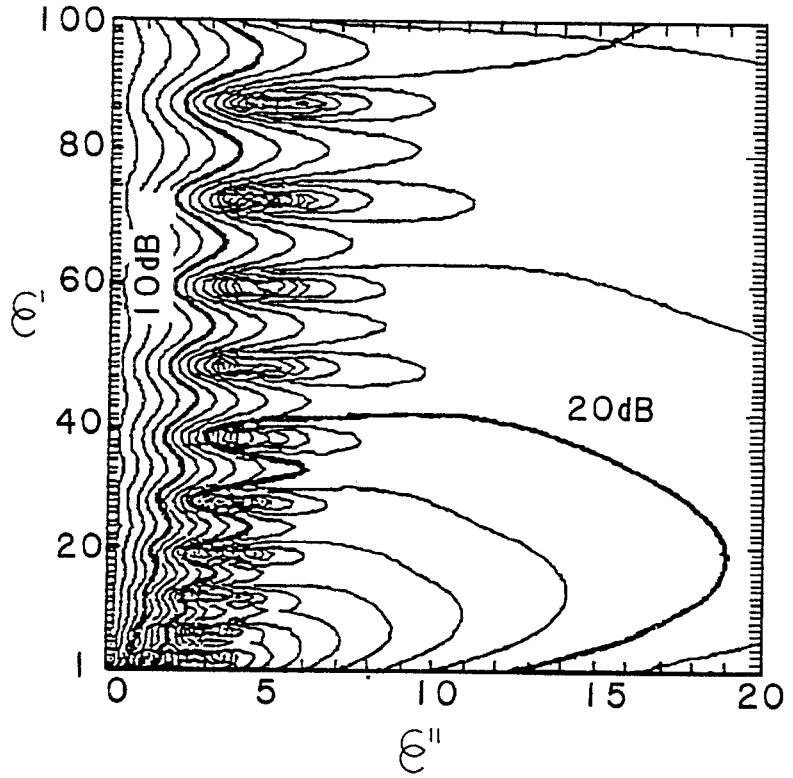

FIGS. 7A and 7B illustrate amounts of the absorptions of the microwave by the different types of the containers, for example, wedged shape container and the squire pyramid container respectively, both of which have the same height of 15 cm. The real part of the dielectric constant appears on the vertical axis, while the imaginary part thereof appears on the horizontal axis. At 10 dB, 1/10 of the microwave is reflected, namely 90% of the microwave is absorbed into the object. At 20 dB, 1/100 of the microwave is reflected, namely 99% of the microwave is absorbed into the object. The square pyramid container is more excellent in a large absorptivity at the same dielectric constant and a wide range of the absorption of the microwave.

Figure 8A:
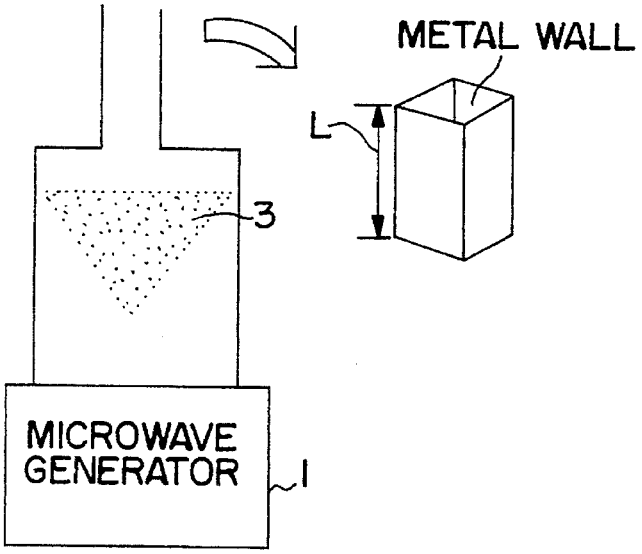
FIGS. 8A and 8B are cross sectional elevation views illustrative of a novel microwave heater in a fifth embodiment according to the present invention.
Figure 8B:
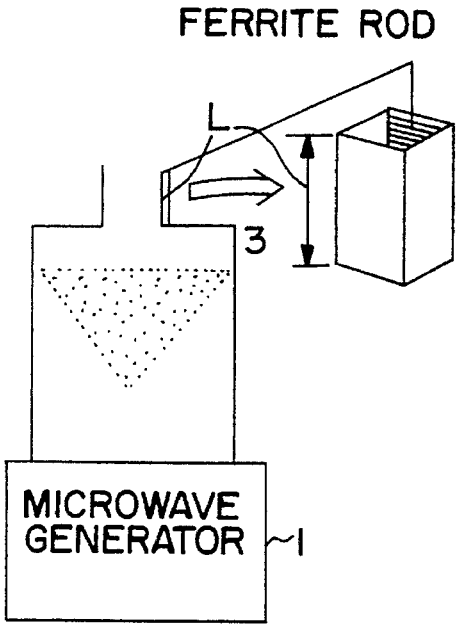
Figure 9:
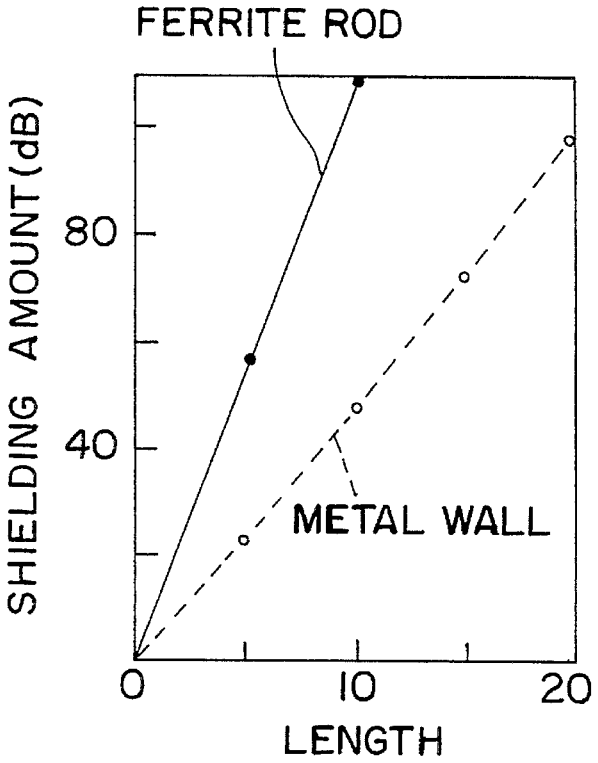
FIG. 9 is a diagram illustrative of a relationship of a shielding amount of microwave and a length of a cutting off mode wave guide.

A fifth embodiment according to the present invention will be described in which a novel microwave generator as illustrated in FIGS. 8A and 8B is provided. The microwave heater has the same structure as those of the first embodiment except for the structure of the cap. The cap may comprise a cut off mode wave guide which has a rectangular-shaped section wherein a long side thereof is equal to or less than a half of the wavelength of the microwave. The cut off mode wave guide may comprise metal walls as illustrated in FIG. 8A, and alternatively may provide a plurality of ferrite rods on the long sides only of the cut off mode wave guide. The ferrite rods are provided in the horizontal direction. The cut off mode wave guide may have a size, for example, 55mm×27.5mm. When providing the ferrite rods, it is possible to shorten the length of the cut off mode wave guide as illustrated in FIG. 8B. It is important that the ferrite rods are provided on the long side only because the provision of the ferrite rods with the magnetic properties only on the long opposite sides may permit the long side walls to show the near property to that of the opening wall. When the long side is set at "a" and the short side is set at "b", the attenuation constant of the cut off mode wave guide illustrated in FIG. 8A is given by $\pi/a$, while the attenuation constant of FIG. 8B is given by $((\pi/a)X2+(\pi/bx\times2)^{1/2}$. Namely, the attenuation constant of the cut off mode wave guide being provided with the ferrite rods. Under the condition of the frequency of 2.45GHz, the ferrite rod is suitable and 1 mm of the diameter thereof is sufficient. In the type of FIG. 8A, to obtain 90 dB corresponding to the actually sufficient amount of the cut off, 20 cm of the length of the cut off mode wave guide is required. By contrast, in the another type of FIG. 8B, 10 cm or less only is required. Those are appreciated from FIG. 9.

Figure 10:
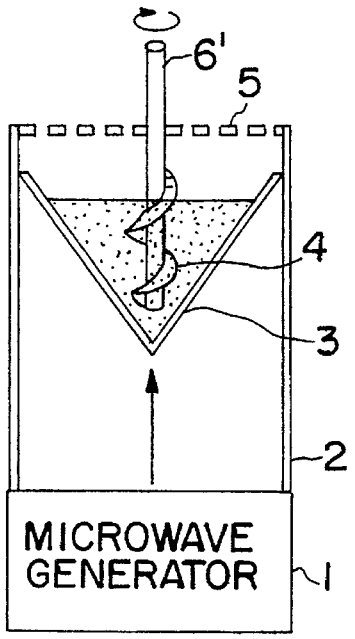
FIGS. 10 and 11 are cross sectional elevation views illustrative of a novel microwave heater in a sixth embodiment according to the present invention.
Figure 11:
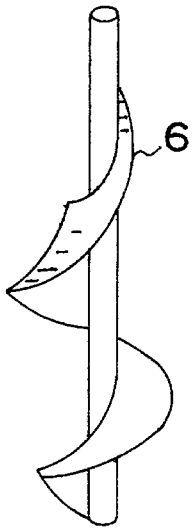

A sixth embodiment according to the present invention will be described in which a novel microwave generator as illustrated in FIG. 10 is provided. The microwave heater has the same structure as those of the foregoing embodiment except in further providing a stirring system for stirring the object accommodated in the container and to be heated up by the microwave so that the object is heated up uniformly. The stirring system may comprise a spiral blade 6 as illustrated in FIGS. 10 and 11. The spiral blade 6 may be made of dielectric materials having a low dielectric loss such as ceramic. The spiral blade 6 is provided along the center axis that rotates so that the spiral blade also shows a rotation thereby part of the object is shoveled up. A heating up rate is not so high. 700 g of dust is heated up and dried for a few minutes by applying 1000 W and 2.45 GHz microwaves. In this case, a rotation speed of the spiral blade for stirring the object may be in the range of from 0.5 to 10 rpm.

As modifications, it is available to provide a plurality of bales for stirring the object even the illustration thereof is omitted.

Figure 12:
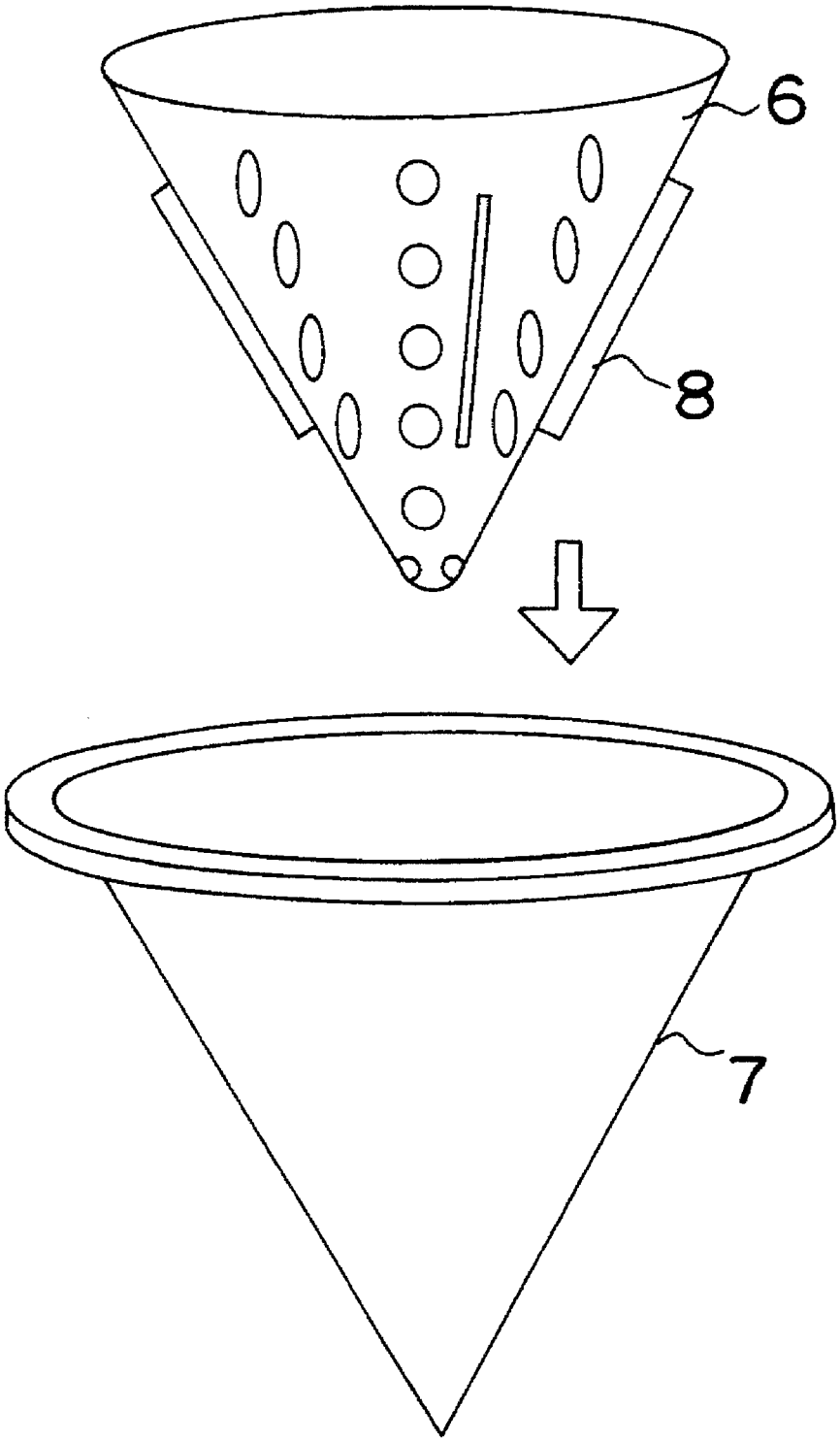
FIG. 12 is a cross sectional elevation view illustrative of a novel microwave heater in a seventh embodiment according to the present invention.

A seventh embodiment according to the present invention will be described in which a novel microwave generator as illustrated in FIG. 12 is provided. The microwave heater has the same structure as those of the foregoing embodiment except in providing double bottomed structure of the container, but the external shape of the container is the same as that of the first embodiment. The container with the tapered bottom has a double structure comprising an inner container 6 and an outer container 7. As illustrated in FIG. 12, the inner container 6 has a plurality of sub-guide rails provided on an external side thereof and a plurality of holes being also provided on the external side. A diameter of the holes provided on the inner container 6.may be in the range of from 1 mm to 10 mm. When the inner container is accommodated in the outer container 7, then a space in the range from 1 mm to 10 mm is created between those. The inner and outer containers 6 and 7 may be made of dielectric materials having a low dielectric loss such as ceramic. It is also possible to provide the holes on the tapered bottom portion only except the side portion.

When the object having a sufficient large amount of moisture is accommodated within the inner container 6, the moisture is dripped through the holes provided on the side and the tapered bottom of the inner container 6 and then gathered in the outer container 7. The container is subjected to the microwave irradiation thereby the moisture is vaporized and discharged through the cap of the punching metal provided at the end of the wave guide 2. This may suppress a scattering of the object on being heated by the microwave by vapor.

Figure 13:
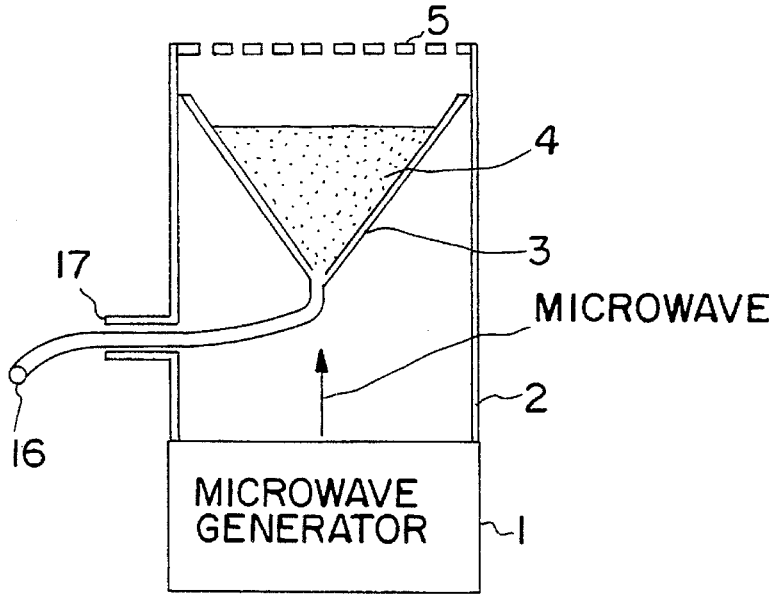
FIGS. 13, 14 and 15 are cross sectional elevation views illustrative of a novel microwave heater in an eighth embodiment according to the present invention.
Figure 14:
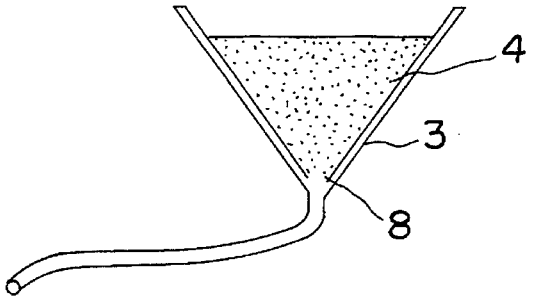
Figure 15:
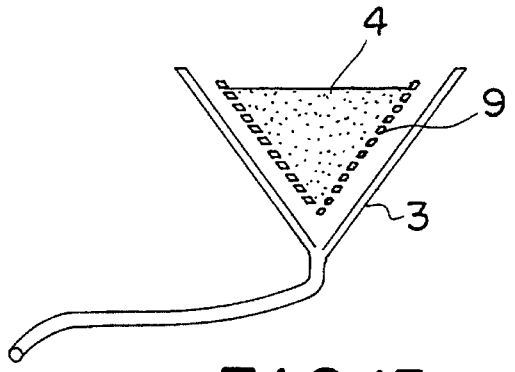
Figure 16:
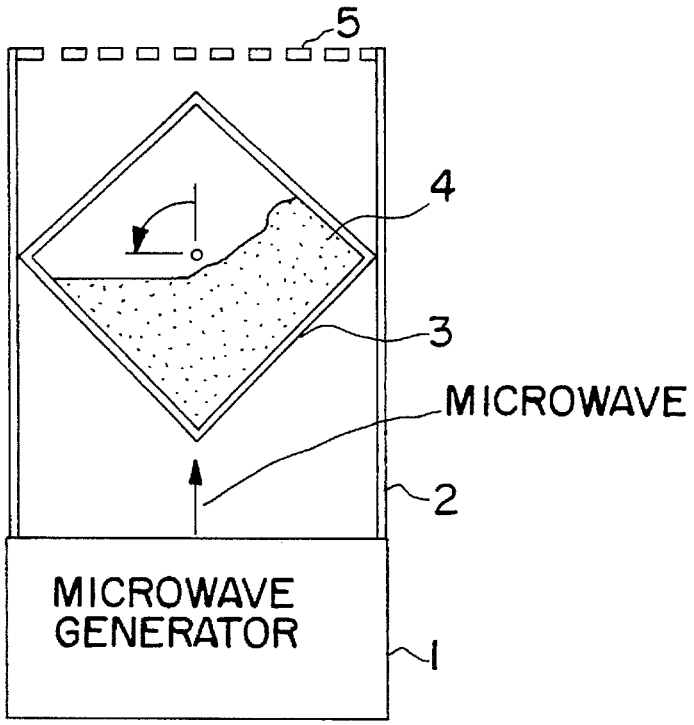
FIGS. 16, 17A–17C and 18 are cross sectional elevation views illustrative of a novel microwave heater in a ninth embodiment according to the present invention.

An eighth embodiment according to the present invention will be described in which a novel microwave generator as illustrated in FIGS. 13, 14 and 15 is provided. The microwave heater has the same structure as those of the foregoing embodiment except in providing the container 3 with the tapered bottom with a hole connecting to a discharge hose 16 that extends from the end of the tapered bottom through a cut off mode wave guide 17 to an exterior of the wave guide. The cut off mode wave guide is provided on the side of the wave guide 2 for guiding the generated microwave to be irradiated on the object to be heated up. The discharge hose 16 may be made of dielectric materials having a low dielectric loss. The cut off mode wave guide through which the discharge house 16 passes is provided to suppress a leakage of the microwave in the wave guide 2. The cut off mode wave guide 17 is positioned at a lower level than that of the bottom end of the tapered container 3. Moisture of the object to be heated up is gathered at the bottom end of the container and then discharged through the discharged house 16 into the exterior of the microwave heater.

As modifications, to prevent the hose from being closed with the object, it may be possible to provide a mashed cap at the boundary between the discharge house 16 and the bottom end of the container 3 as illustrated in FIG. 14. Alternatively, it may be available to provide an inner meshed container 9 for directly accommodating the object to be heated up so that the moisture part of the object is dropped out through the meshed inner container 9 on the outer container 3 and then gathered at the bottom end thereof to be discharged through the discharge house 16 into the exterior of the microwave heater as illustrated in FIG. 15.

Figure 17A:
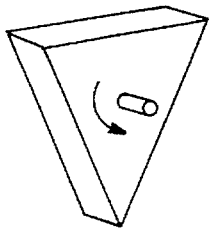
Figure 17B:
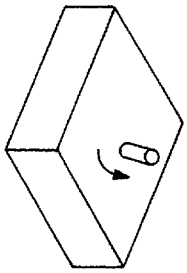
Figure 17C:
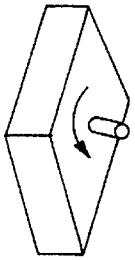

A ninth embodiment according to the present invention will be described in which a novel microwave generator as illustrated in FIGS. 16, 17A–17C and 18 is provided. The microwave heater has the same structure as those of the foregoing embodiment except in providing a rotatable closed container 3 that is able to rotate around a horizontal axis during the heating up of the object. The rotatable closed container 3 may have various shapes of pillars such as triangle, square and diamond-shape as illustrated in FIGS. 17A, 17B and 17C. The rotation appears in a predetermined time interval. During the application of the microwave to the object accommodated in the pillar closed container, the container is kept in a position wherein any one of the corners of the pillar container 3 faces to the downward direction or the propagating direction of the microwave for a predetermined time interval, followed by a rotation of the container at a predetermined angle so that other one of the corners of the pillar container 3 faces to the propagating direction of the microwave. For example, the triangle container rotates at 120 degrees at one time, while the square and diamond shape containers rotate at 90 and 180 degrees respectively. The rotation of the container at the predetermined time interval may permit uniform heating up of the object accommodated in the closed pillar container.

Figure 18:
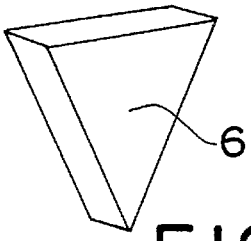

As a modification, the closed pillar container may comprise a meshed pillar container as illustrated in FIG. 18 so that to facilitate removal of the moisture of the object.

Whereas modifications of the present invention will no doubt be apparent to a person having ordinary skill in the art, to which the invention pertains, it is to be understood that embodiments shown and described by way of illustrations are by no means intended to be considered in a limiting sense. Accordingly, it is to be intended to cover by claims all modifications of the present invention which fall within the spirit and scope of the invention.

What is claimed is:

1. An electromagnetic wave heater comprising:

an electromagnetic wave generator;

a wave guide connected to said generator for guiding the generated electromagnetic wave to be propagated in a uniform direction;

at least one container provided in said wave guide for accommodating an object to be heated up by irradiation of said electromagnetic wave, the volume of said container having at least one tapered portion which is pointed, at an end portion thereof, toward said electromagnetic wave generator.

2. The heater as claimed in claim 1, wherein said container has a conical shape.

3. The heater as claimed in claim 1, wherein said container has a pyramidal shape.

4. The heater as claimed in claim 1, wherein said container has a triangle pillar shape, provided that any one of corners of the pillar is pointed and directed toward said electromagnetic wave generator.

5. The heater as claimed in claim 1, wherein said container has a square pillar shape, provided that any one of corners of the pillar is pointed and directed toward said electromagnetic wave generator.

6. The heater as claimed in claim 1, wherein said container has a diamond pillar shape, provided that any one of corners of the pillar is pointed and directed toward said electromagnetic wave generator.

7. The heater as claimed in claim 1, further comprising:

a cutting-off mode rectangularly-shaped wave guide for shielding the electromagnetic wave after irradiation on the object to prevent the electromagnetic waves from being leaked out to an exterior of said heater, said cutting-off mode rectangularly-shaped wave guide having a long side with a length which is less than a half of a wavelength of the electromagnetic wave to be irradiated on said object to be heated up; and a ferrite film provided only on a face adjacent to any on of long sides of said cutting-off mode rectangularly-shaped wave guide.

* * * * *